US011134794B2

(12) United States Patent
Allen

(10) Patent No.: US 11,134,794 B2
(45) Date of Patent: Oct. 5, 2021

(54) CHILD CARRIER PACK

(71) Applicant: CUK LLC, Boise, ID (US)

(72) Inventor: Shannon Allen, Boise, ID (US)

( * ) Notice: Subject to any disclaimer, the term of this patent is extended or adjusted under 35 U.S.C. 154(b) by 0 days.

(21) Appl. No.: 16/879,730

(22) Filed: May 20, 2020

(65) Prior Publication Data

US 2020/0367666 A1 Nov. 26, 2020

Related U.S. Application Data

(60) Provisional application No. 62/850,370, filed on May 20, 2019.

(51) Int. Cl.
*A47D 13/02* (2006.01)
*A45F 3/02* (2006.01)

(52) U.S. Cl.
CPC ..... *A47D 13/025* (2013.01); *A45F 3/02* (2013.01)

(58) Field of Classification Search
CPC ..... A47D 13/025; A45F 3/02
See application file for complete search history.

(56) References Cited

U.S. PATENT DOCUMENTS 1,162,662 A * 11/1915 Sprong ..... A47D 13/025 224/160
2,411,721 A 11/1944 Hancock
2,468,588 A 8/1946 Clemens
2,690,864 A 5/1950 Dautermann
2,804,249 A 10/1955 Manalo
3,327,914 A 6/1967 Abram
3,575,326 A 4/1971 Chappell
4,389,005 A * 6/1983 Cable ..... A47D 13/025 224/159
4,402,440 A * 9/1983 Purtzer ..... A47D 13/025 224/159
4,428,514 A 1/1984 Elf
4,436,233 A 3/1984 Hill
4,487,346 A 12/1984 Fischer, Jr.
4,637,535 A 1/1987 Aleman
4,750,653 A 6/1988 Prunty
4,757,925 A 7/1988 Knittel
5,071,047 A 12/1991 Cordisco
5,318,084 A 6/1994 Jackson
5,492,256 A 2/1996 Ive
5,522,528 A * 6/1996 Petricola ..... A47D 13/025 224/160

(Continued)

FOREIGN PATENT DOCUMENTS

DE 202016100222 3/2016
GB 1560260 A 1/1980

(Continued)

*Primary Examiner* — Justin M Larson
(74) *Attorney, Agent, or Firm* — Scott D. Swanson; Shaver and Swanson, LLP

(57) ABSTRACT

A child carrying pack with at least one shoulder strap and a carrying sling configured for supporting the weight of a child. The carrying sling attaches to multiple location on the pack allowing for multiple combinations based on the user's preference or comfort. The carrying sling may include a seat pad. The child carrying pack may include a safety strap configured to secure a child into the carrying sling. The shoulder strap can attach to the pack in multiple locations allowing for further configurations.

17 Claims, 9 Drawing Sheets

(56) References Cited

U.S. PATENT DOCUMENTS 5,685,466 A * 11/1997 Hsieh ..... A47D 13/025 224/159
5,713,439 A * 2/1998 Zionts ..... A45C 5/14 150/108
5,727,720 A * 3/1998 Thatcher ..... A45F 3/00 224/582
5,813,580 A 9/1998 Fair
6,378,746 B1 4/2002 Miller
6,409,060 B2 * 6/2002 Donine ..... A47D 13/025 224/160
6,520,391 B2 2/2003 Yen
6,595,396 B2 7/2003 Cummings
6,793,112 B2 * 9/2004 Ammerman ..... A45F 3/02 224/257
6,866,173 B2 * 3/2005 Haber ..... A45F 3/04 224/160
6,886,726 B1 * 5/2005 O'Hare ..... A01K 97/06 224/576
7,669,743 B2 3/2010 Bruton
7,770,765 B2 8/2010 Stevens
7,909,214 B2 * 3/2011 Gold ..... A45F 3/02 224/625
9,144,322 B2 * 9/2015 Gillam ..... A47D 13/02
9,198,525 B2 12/2015 Wernick
9,259,100 B2 2/2016 Ng
D754,440 S * 4/2016 Ford ..... D3/318
9,439,516 B2 * 9/2016 Workman ..... A47D 13/025
9,498,071 B2 11/2016 Mossman
9,730,499 B2 * 8/2017 Ford ..... A45C 9/00
D802,913 S 11/2017 Tien
10,136,713 B2 * 11/2018 Ford ..... A45C 13/30
2004/0016780 A1 1/2004 Cummings
2004/0031827 A1 * 2/2004 Haber ..... A45F 3/04 224/160
2004/0149790 A1 * 8/2004 Kassai ..... A47D 13/025 224/160
2004/0182895 A1 9/2004 Paul
2004/0244097 A1 * 12/2004 Kassai ..... A47D 13/025 2/310
2005/0224535 A1 10/2005 Bruton
2007/0029356 A1 * 2/2007 Moriguchi ..... A47D 13/02 224/160
2008/0029564 A1 * 2/2008 Wong ..... A63B 47/00 224/600
2008/0047987 A1 2/2008 Price
2009/0205758 A1 * 8/2009 Mankelow ..... A45C 3/06 150/106
2010/0051658 A1 3/2010 Parness
2011/0192877 A1 * 8/2011 Murdoch ..... A45F 3/02 224/607
2016/0106228 A1 * 4/2016 Wang ..... A47D 13/025 224/159
2017/0055722 A1 3/2017 Gusky
2020/0367666 A1 * 11/2020 Allen ..... A45F 3/02
2020/0383495 A1 * 12/2020 Sheldrick ..... A47D 13/025
2021/0093098 A1 * 4/2021 Ross ..... A45F 4/02

FOREIGN PATENT DOCUMENTS

GB 2476401 A 6/2011
JP 2013240552 A 12/2013
KR 200212061 Y1 2/2001
WO WO-2011/071441 A1 6/2011

* cited by examiner

CHILD CARRIER PACK

PRIORITY/CROSS-REFERENCE TO RELATED APPLICATIONS

This application claims the benefit of U.S. Provisional Application No. 62/850,370, filed May 20, 2019 the disclosure of which is incorporated by reference.

TECHNICAL FIELD

The presently disclosed technology relates to child carriers. More particularly it relates to a pack having a sling utilized as a child seat.

BACKGROUND

At almost any event or location, whether it be a city park, an amusement park, a school function, the mall, or the grocery store, parents and adults are carrying small children. Typically, parents can carry their children in their arms or on their shoulders. However, this can result in muscle fatigue in the shoulders, arms, and back. Alternatively, parents can use child carrying packs, in which a child seat or carrier is integrated into the pack, such as in the Osprey Poco®. However, child carrying packs can be bulky.

What is needed is a convenient way to hold a child that allows a wearer to still use his or her arms. What is further needed is a mechanism that is removable and/or easy to store.

SUMMARY OF

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

In accordance with the present invention a child carrying pack. The child carrying pack includes a pack with at least one shoulder strap and a carrier sling. The carrier sling is used to provide a child seat or seat pad for a child to sit on when the pack is worn by another person. The carrier sling is preferably adjustable in length. The carrier sling preferably attaches to shoulder strap and the bottom of the pack. In alternate embodiments, the carrier sling is configured to attach to the child carrying pack in multiple positions, including but not limited to on the top of the pack and the bottom of the pack, the shoulder and the right or left side of the pack, the top and bottom of the shoulder strap, opposite sides of the pack, or any other position that allows a child to safely sit on the carrier sling attached to the child carrying pack. The carrier sling is preferably configured to be removed and efficiently stored in the pack.

In a preferred embodiment, the child carrying pack includes a safety strap. The safety strap is preferably configured to attach to the pack behind the wearer. The child carrying pack preferably includes at least one handle. The handle is preferably positioned on the shoulder strap. In this preferred embodiment, the child carrying pack is configured such that a child sits on the child seat facing the body of the wearer and grasps the handles on the child carrier pack and/or is secured by the safety strap. In another embodiment, the handles are positioned on the pack in a position such that a child can grasp it to secure the child's position in the carrier sling.

In a preferred embodiment, the child safety strap is configured to secure a child in the carrier sling. The safety strap preferably attaches to clasps inside a back pocket on in the pack. In one embodiment, the safety strap is adjustable. In another embodiment, the safety strap is two separate straps that join together to secure the child in the carrier sling.

In a preferred embodiment, the child seat is a cushioned pad that is wider than the carrier sling and allows a child to comfortably sit on when the child carrying pack is in use.

In a preferred embodiment, the shoulder strap is integrally attached to the top of the center of pack. The lower end of the shoulder strap is preferably configured to attach to the right or left side of the pack such that the user can change the positioning of the strap for comfort. In alternate embodiments, the shoulder strap is fixedly attached to the top of the pack and to the right or left side of the pack such that its position is fixed. In another embodiment the pack has two shoulder straps.

As described above, the child carrying pack includes a plurality of clasps or attachment clips. The child carrying pack preferably includes a clasp on the shoulder strap configured to attach one end of the carrier sling and another clasp configured to attach the shoulder strap to one side of the pack. The clasps are preferably plastic buckle clasps. In alternate embodiments, other clasps can be used, including but not limited to clips, ties, carabiners, or any other construction commonly used to attach straps. The clasps can be constructed from metal, plastic, or fabric.

In one embodiment, the pack has a pouch or pocket on the side facing a user's back that is configured to store the safety strap and carrier sling when either is not in use.

A variety of packs can be used in, including but not limited to a backpack, day bag, CamelBak®, or any type of pack used to store items on the go. The carrier sling and safety straps can be constructed for use with specific pack or as an aftermarket addition to a commercial pack.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
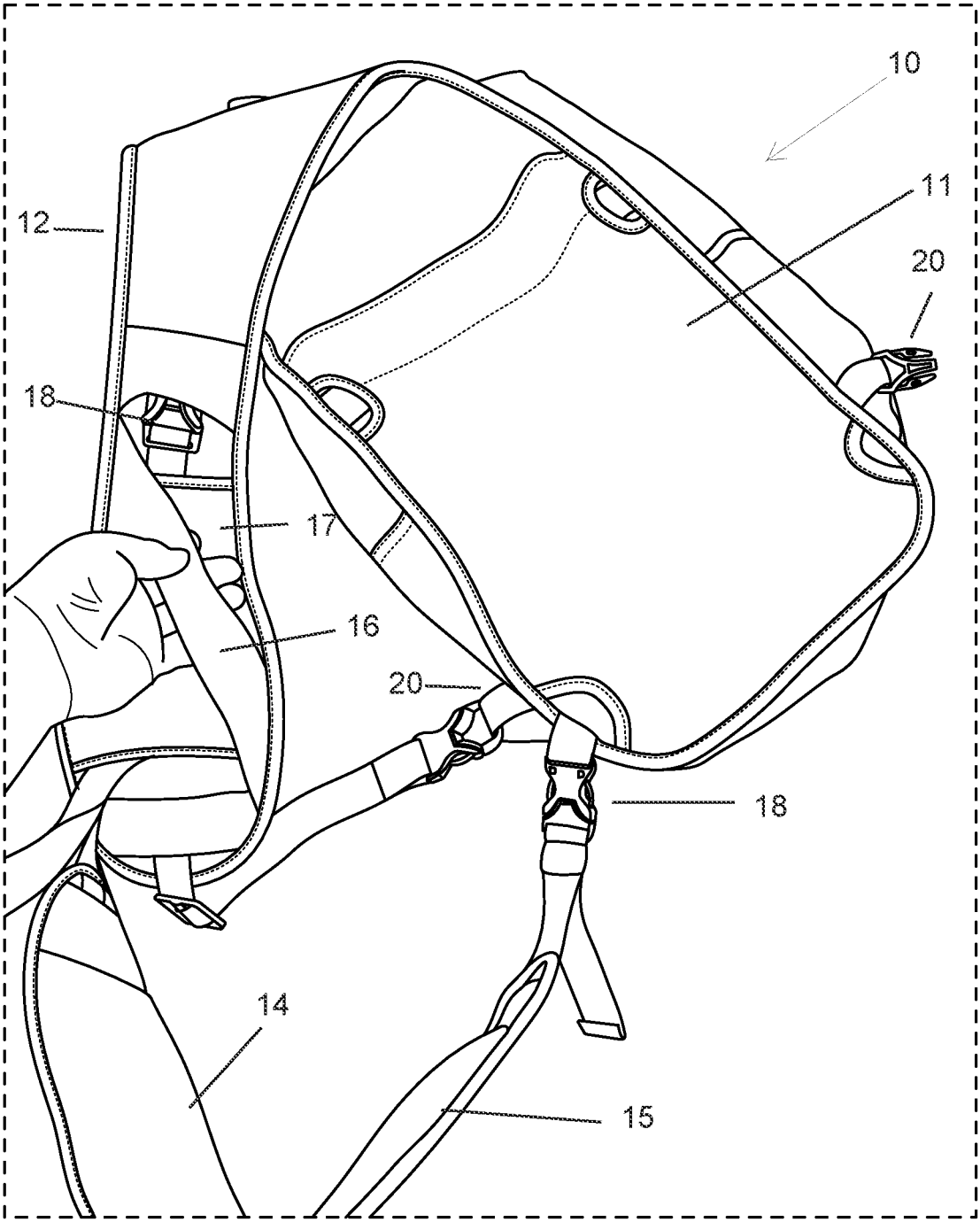
FIG. 1 is a front view of an embodiment of the child carrying pack.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

FIG. 1 depicts an embodiment of the child carrier pack 10. In a preferred embodiment the child carrier pack 10 has a pack 11 with a shoulder strap 12 and a carrier sling 14. The carrier sling 14 is used to provide a seat pad 15 for a child to sit on when the pack 11 is worn by another person.

The carrier sling 14 is preferably configured to attach to the pack 11 and the shoulder strap 12. The shoulder strap 12 preferably has a handle 16 configured for a child seated in the carrier sling 14 to grasp to secure the child in the carrier sling 14. In alternate embodiments the handle can be positioned on the pack such that a child can grasp it to secure the child in the carrier sling. The shoulder strap 12 preferably includes a sleeve 17 positioned under the handle 16 reducing the adjustable strap of the carrier sling 14 from interfering with a user or child sitting in the carrier sling 14.

The carrier sling 14 is preferably configured to attach to child carrier pack 10 via clasps 18. In a preferred embodiment, clasps 18 are positioned on the shoulder strap 12 and on the lower portion of the pack 11.

In alternate embodiments, the child carrier pack can include more clasps located in multiple different positions such that a user can adjust the position of the carrier sling, including on the opposite side or to the rear of the pack/user. Additional clasps allow for further combinations of attachment points of the carrying sling.

The child carrier pack 10 preferably includes a plurality of shoulder strap clasps 20. The shoulder strap clasps 20 are configured for attaching the lower end of the shoulder strap 12 to either side of the pack 11. This allows a user to adjust the side of the shoulder strap 12, based on comfort or preference.

In a preferred embodiment, the shoulder strap 12 and the carrier sling 14 are adjustable in length. In alternate embodiments, the lengths of the shoulder strap or the carrier sling are fixed.

In a preferred embodiment, the pack 11 has a pouch 22 on the side of the pack 11 adjacent to a user's back when the child carrier pack 10 is in use. The pouch 22 provides storage, preferably for storing the carrier sling 14 and/or the safety strap (illustrated in FIG. 4). The pouch 22 preferably has openings 24 on each side configured for a strap to extend through such that the safety strap can be attached within the pouch (illustrated in FIG. 3).

Figure 2:
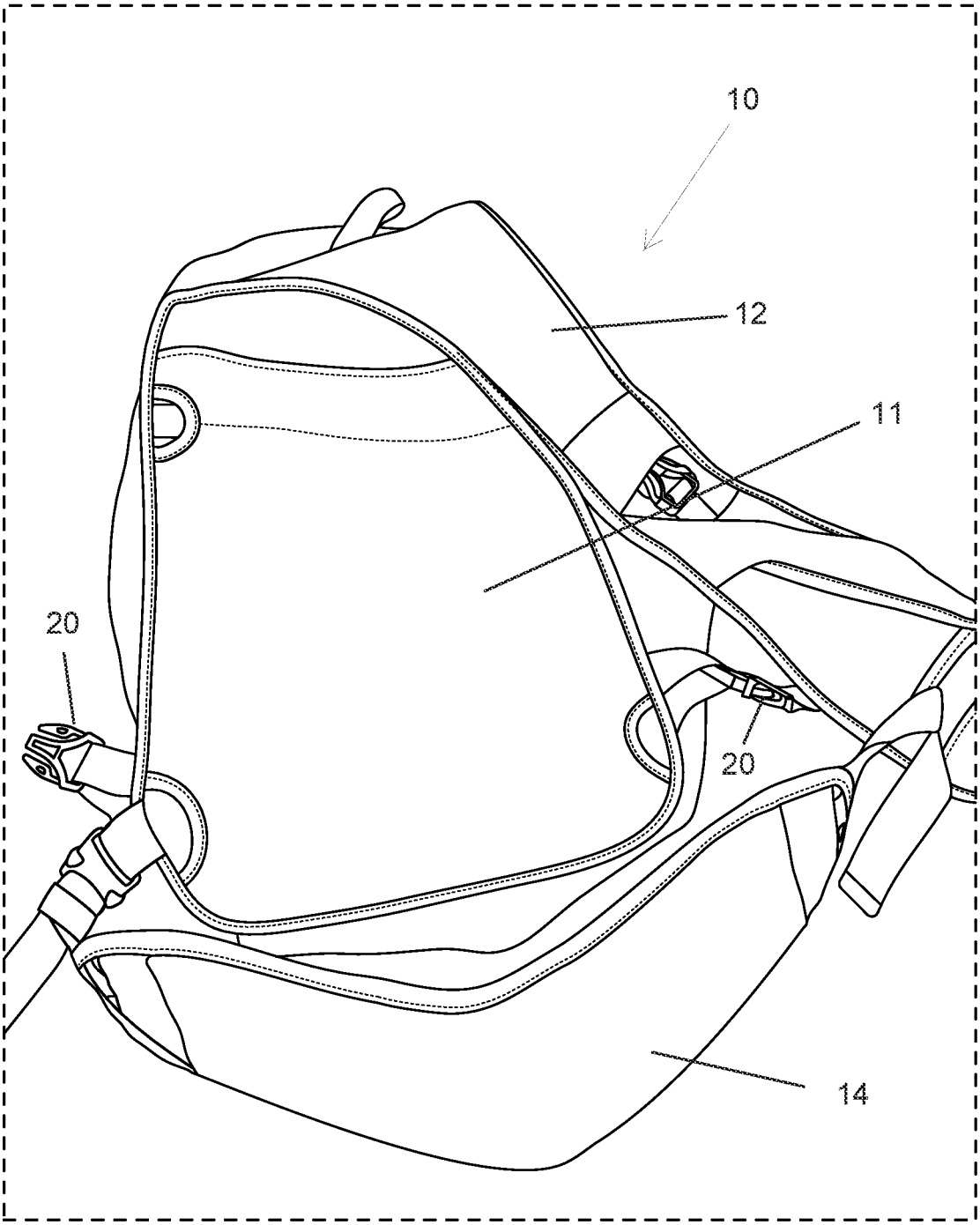
FIG. 2 is a front view of the child carrying pack in FIG. 1 with the shoulder strap attached to the opposite side.

FIG. 2 illustrates the child carrier pack 10 with shoulder strap 12 attached to clasp 20 on the opposite side as FIG. 1. The shoulder strap 12 is preferably attached to the center of the top of the pack such that the shoulder strap 12 can easily switch between the right and left side of the pack 11. In the configuration illustrated in FIG. 2, the child carrier sling 14 is configured to extend across the body of the user.

Figure 3:
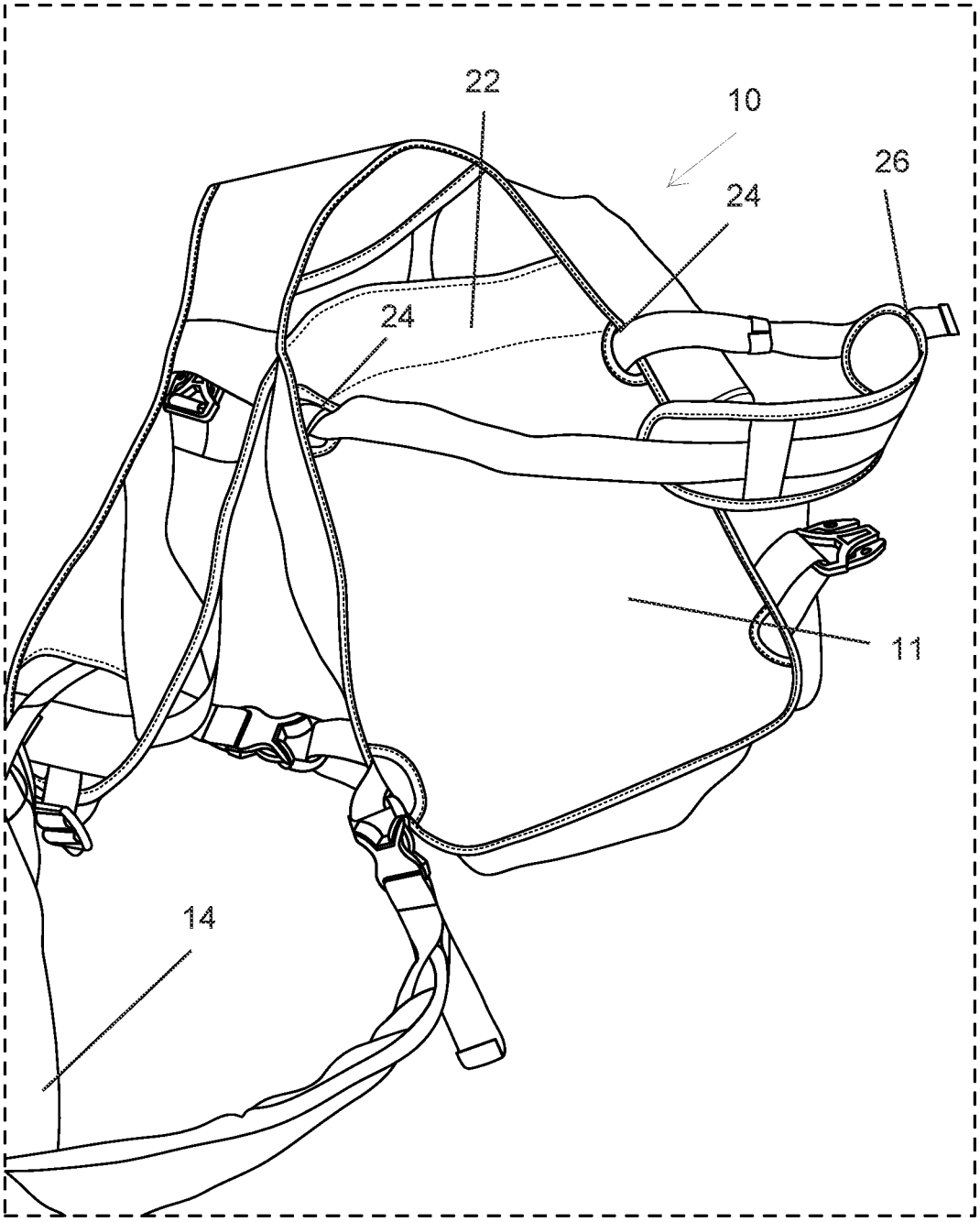
FIG. 3 is a front view of the child carrying pack in FIG. 1 with an embodiment of the safety strap attached.

FIG. 3 illustrates a preferred embodiment of the child carrier pack 10 with a safety strap 26. The safety strap 26 is configured to secure a child into the child carrier sling 14 by extending around the body/backside of a child. The safety strap 26 preferably attaches to the pack 11 inside the pouch 22 through the openings 24. The safety strap 26 is preferably configured to attach to clasps. In alternate embodiments the safety strap is fixedly attached to the pack.

Figure 4:
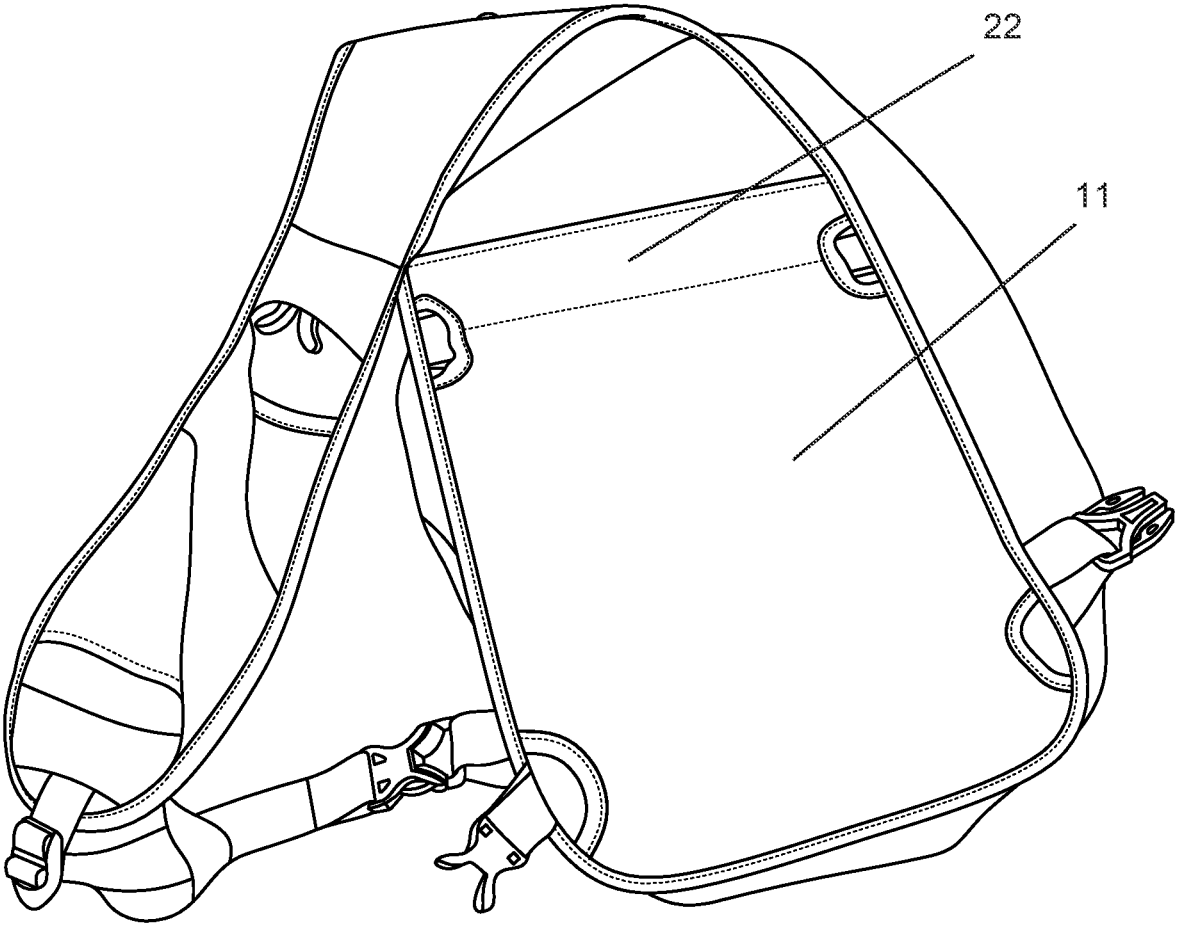
FIG. 4 is a front view of a of the child carrying pack in FIG. 1 with the carrier sling and the safety strap stored in pack.

FIG. 4 illustrates an embodiment of the pack with the child carrier sling (not illustrated) and safety strap (not illustrated) stored in the pouch 22. This allows the user to use the pack 11 and allows the user to transport the carrier sling and safety strap when the child does not require to be carried. The child carrier sling and the safety strap are configured to be folded or rolled such that they can be easily stored.

Figure 5:
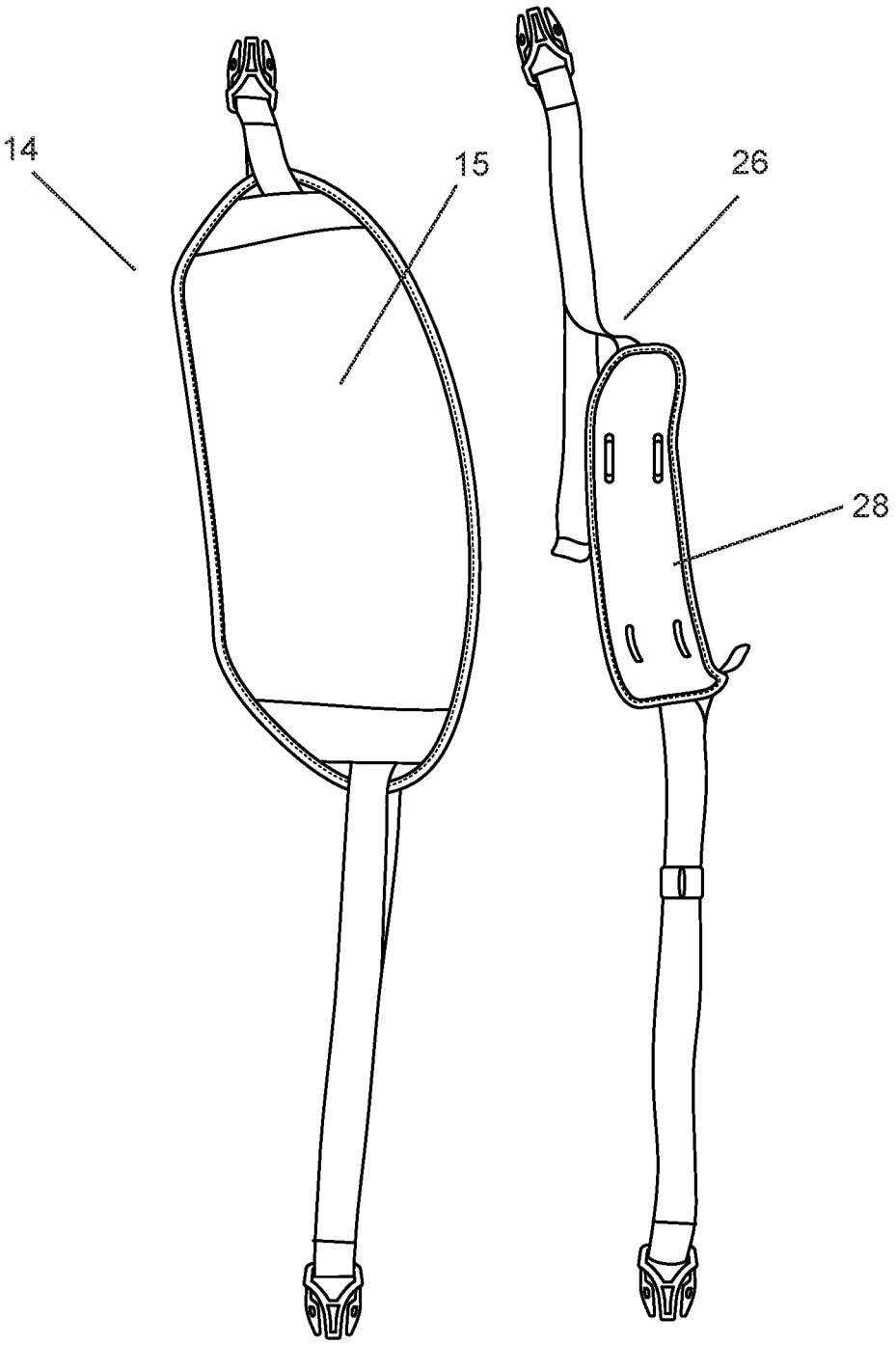
FIG. 5 is a front view of embodiments of a carrier sling and safety strap.

FIG. 5 illustrates preferred embodiments of the carrier sling 14 and the safety strap 26. The child carrier sling and safety strap are preferably constructed lightweight material including, but not limited to fabric (such as cotton), polyester, nylon or other material commonly used in backpack construction. The carrier sling 14 preferably has a seat pad 15 that allows for a child to comfortably sit in the carrier sling 14. The safety strap preferably has a rear support pad 28 that provides support to a child's back or midsection (if the child is seated away from the user).

Figure 6:
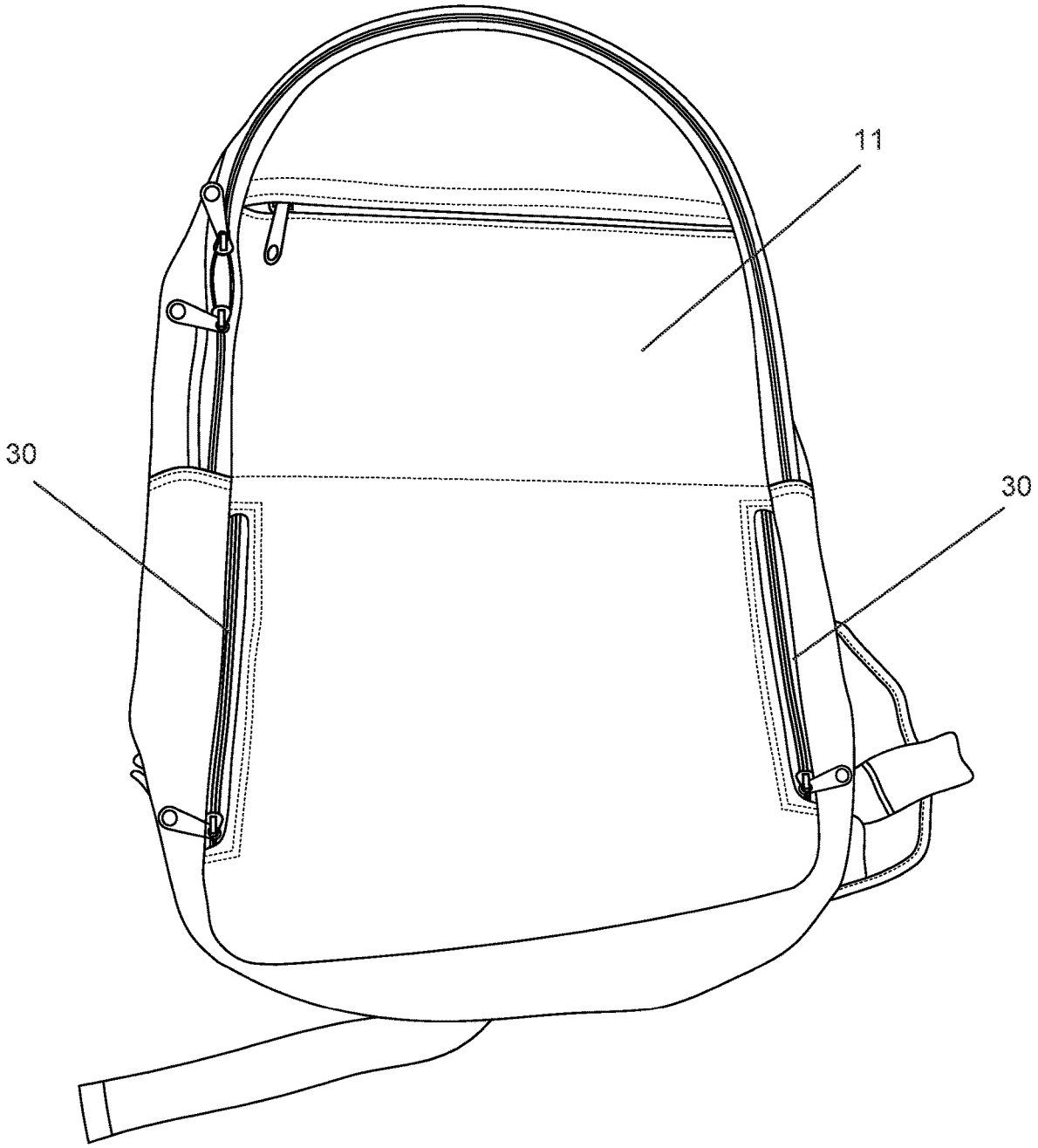
FIG. 6 is a rear view of an embodiment of the child carrying pack.

FIG. 6 illustrates a preferred embodiment of the pack 11. The pack 11 can include a series of pockets 30. In alternate embodiments, the pack 11 can utilize more or fewer pockets.

Figure 7:
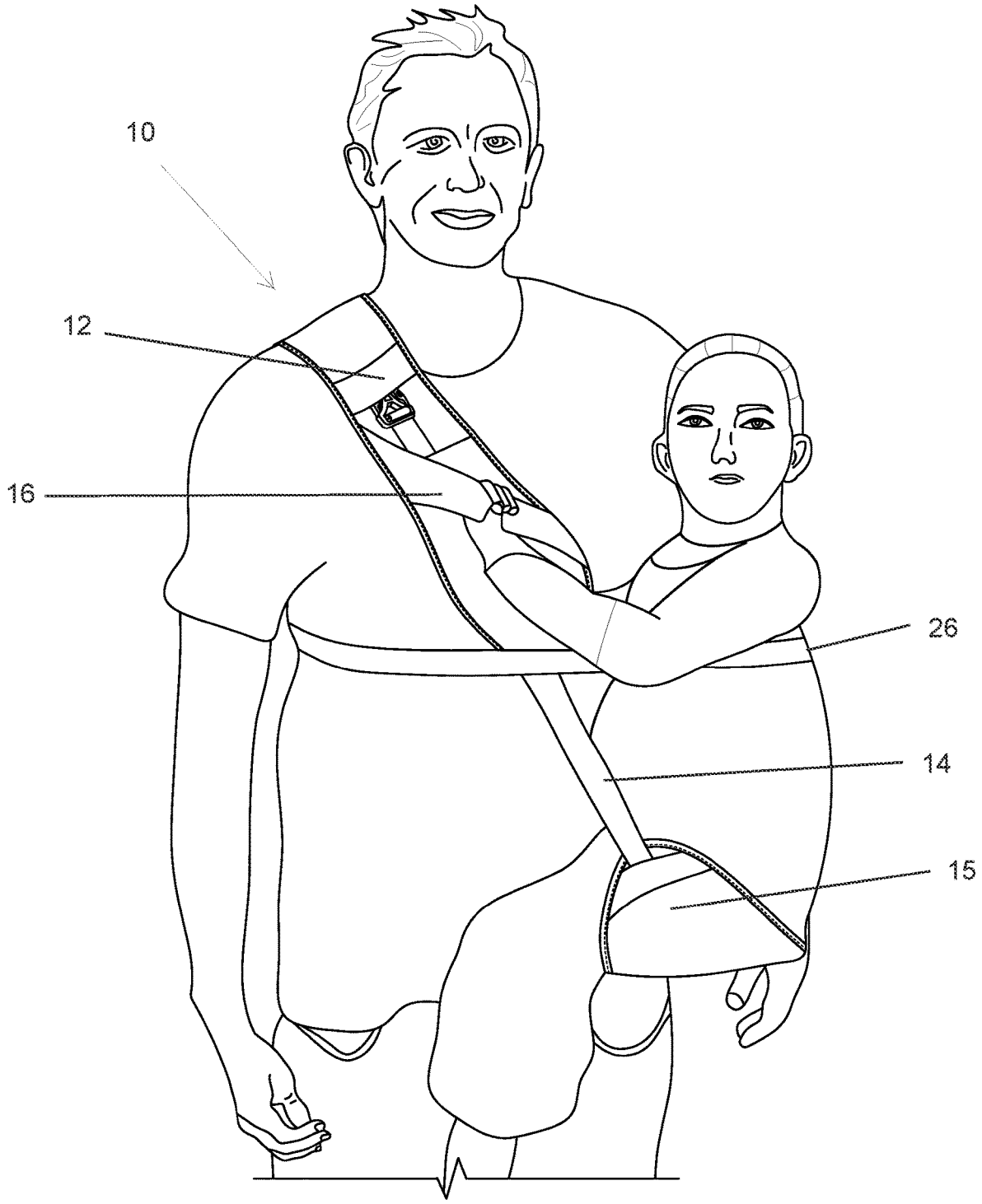
FIG. 7 is a front view of an embodiment of the child carrying pack with a child in the carrier sling in a side position.
Figure 8:
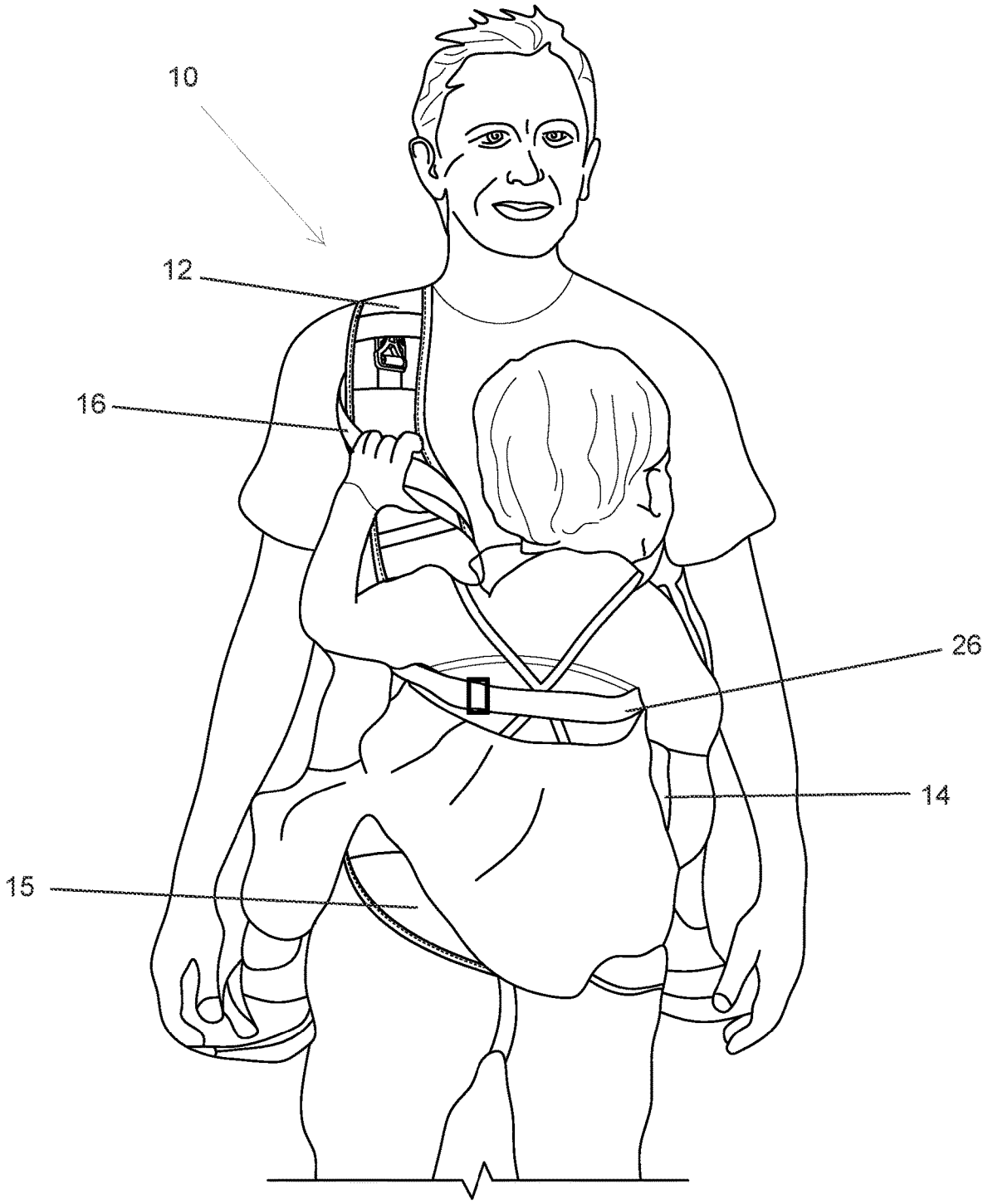
FIG. 8 is a front view of an embodiment of the child carrying pack with a child in the carrier sling in a center position.
Figure 9:
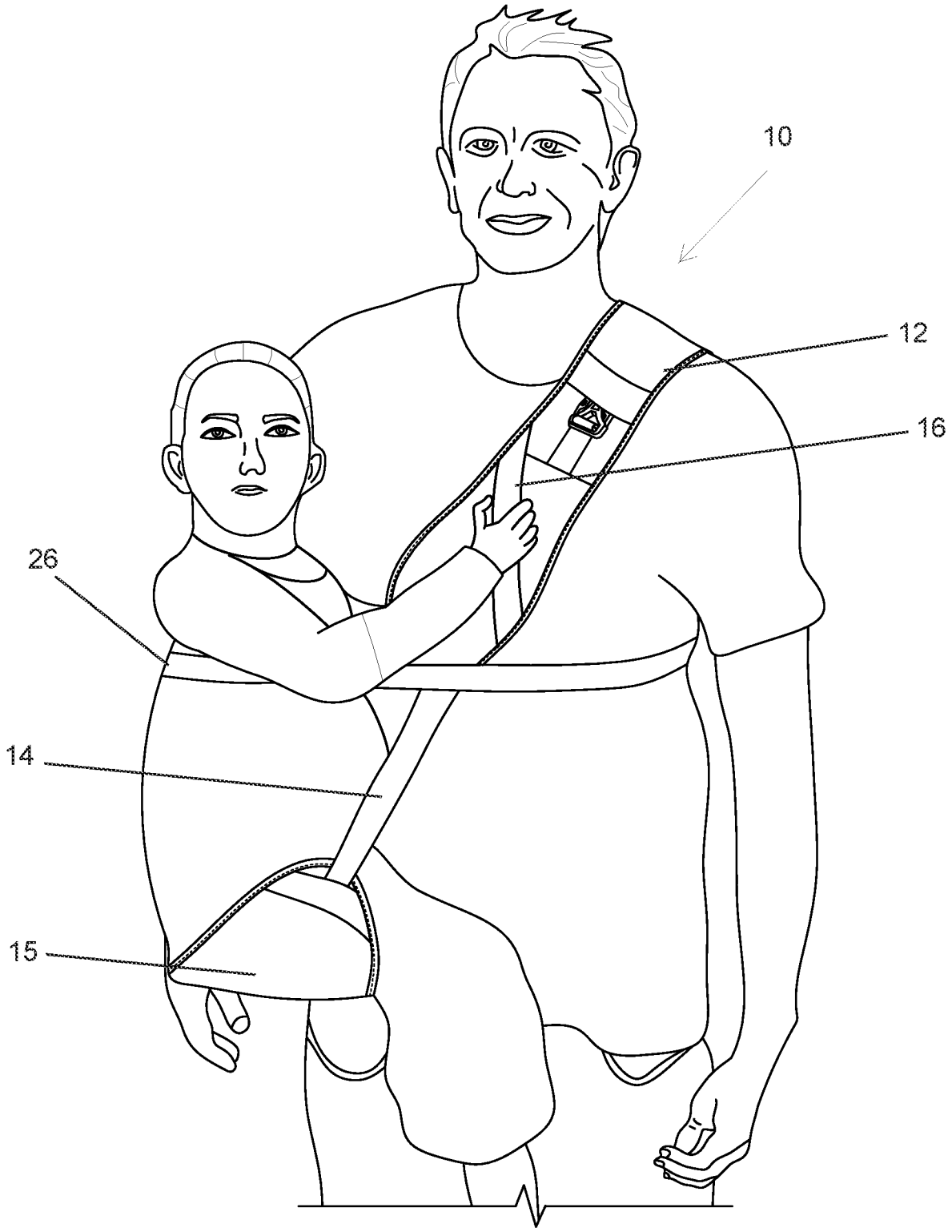
FIG. 9 is a front view of an embodiment of the child carrying pack with a child in the carrier sling in a side position opposite of FIG. 7.

FIGS. 7-9 illustrate alternate configurations of the child carrier pack 10.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A child carrying pack comprising:

a pack, said pack having a shoulder strap, said pack comprising a plurality of clasps;

a carrier sling, said carrier sling comprising a first end and a second end, wherein said first end is configured to attach to a first clasp of said plurality of clasps and said second end is configured to attach to a second clasp of said plurality of clasps;

a child seat, said child seat being positioned between said first end and said second end of said carrier sling;

wherein said carrier sling being configured such that when said first end and said second end are attached to said first clasp and said second clasp, respectively, said carrier sling is configured to support the weight of a child in said child seat; wherein a top of said shoulder strap is fixedly attached to a center of a top of said pack, and wherein a bottom of said shoulder strap is configured to attach to a right side or a left side of a bottom of said pack.

2. The child carrying pack of claim 1, wherein said first clasp is positioned on said shoulder strap.

3. The child carrying pack of claim 1, wherein said second clasp is positioned on the lower half of said pack.

4. The child carrying pack of claim 1, wherein said pack comprises a safety strap, said safety strap having a first end and a second end, wherein said first end of said safety strap is configured to attach to the right back side of said pack, wherein said second end is configured to attach to the left back side of said pack, wherein said safety strap is configured to secure a child in said carrier sling.

5. The child carrying pack of claim 1, wherein said pack comprises a handle, wherein said handle is configured for a child to grasp.

6. The child carrying pack of claim 5, wherein said handle is positioned on said shoulder strap.

7. The child carrying pack of claim 1, wherein said carrier sling is configured to be removable and stored in said pack.

8. The child carrying pack of claim 4, wherein said safety strap is configured to be removable and stored in said pack.

9. A child carrying pack comprising:

a pack, said pack having a shoulder strap, said pack comprising a plurality of clasps, wherein a first clasp of said plurality of clasps is positioned on said shoulder strap;

a carrier sling, said carrier sling comprising a first end and a second end, wherein said first end is configured to attach to said first clasp and said second end is configured to attach to a second clasp of said plurality of clasps;

a child seat, said child seat being positioned between said first end and said second end;

wherein said carrier sling being configured so that when said first end and said second end are attached to said first clasp and said second clasp, respectively, said carrier sling is configured to support the weight of a child in said child seat;

wherein said carrier sling is configured to be removable and stored in said pack; wherein a top of said shoulder strap is fixedly attached to a center of a top of said pack, and wherein a bottom of said shoulder strap is configured to attach to a right side or a left side of a bottom of said pack.

10. The child carrying pack of claim 9, wherein said second clasp is positioned on the lower portion of said pack.

11. The child carrying pack of claim 9 wherein said pack further comprises a safety strap, said safety strap having a first end and a second end, wherein said first end of said safety strap is configured to attach to the right back side of said pack, wherein said second end is configured to attach to the left back side of said pack, wherein said safety strap is configured to secure a child in said carrier sling.

12. The child carrying pack of claim 9, wherein said pack comprises a handle, wherein said handle is configured for a child to grasp.

13. The child carrying pack of claim 12, wherein said handle is positioned on said shoulder strap.

14. The child carrying pack of claim 11, wherein said safety strap is configured to be removable and stored in said pack.

15. A child carrying pack comprising:

a pack, said pack having a shoulder strap, said pack comprising a plurality of clasps, wherein a first clasp of said plurality of clasps is positioned on said shoulder strap;

a carrier sling, said carrier sling comprising a first end and a second end, wherein said first end is configured to attach to said first clasp and said second end is configured to attach to a second clasp of said plurality of clasps;

a child seat, said child seat being positioned between said first end and said second end;

wherein said carrier sling being configured so that when said first end and said second end are attached to said first clasp and said second clasp, respectively, said carrier sling is configured to support the weight of a child in said child seat;

wherein said carrier sling is configured to be removable and stored in said pack;

a safety strap, said safety strap having a first end and a second end, wherein said first end of said safety strap is configured to attach to the right back side of said pack, wherein said second end of said safety strap is configured to attach to the left back side of said pack, wherein said safety strap is configured to secure a child in said carrier sling, wherein said safety strap is configured to be removable and stored in said pack; wherein a top of said shoulder strap is fixedly attached to a center of a top of said pack, and wherein a bottom of said shoulder strap is configured to attach to a right side or a left side of a bottom of said pack.

16. The child carrying pack of claim 15, wherein said second clasp is positioned on the lower portion of said pack.

17. The child carrying pack of claim 15, wherein said shoulder strap comprises a handle, wherein said handle is configured for a child to grasp.

* * * * *